US012109505B2

(12) United States Patent
Cheng

(10) Patent No.: US 12,109,505 B2
(45) Date of Patent: Oct. 8, 2024

(54) MOTION SIMULATING APPARATUS

(71) Applicant: BROGENT TECHNOLOGIES INC., Kaohsiung (TW)

(72) Inventor: Tien-Ni Cheng, Kaohsiung (TW)

(73) Assignee: BROGENT TECHNOLOGIES INC., Kaohsiung (TW)

( * ) Notice: Subject to any disclaimer, the term of this patent is extended or adjusted under 35 U.S.C. 154(b) by 388 days.

(21) Appl. No.: 17/726,488

(22) Filed: Apr. 21, 2022

(65) Prior Publication Data

US 2022/0410020 A1 Dec. 29, 2022

(30) Foreign Application Priority Data

Jun. 26, 2021 (TW) ..... 110123470

(51) Int. Cl.
*A63G 31/02* (2006.01)
*A63G 31/16* (2006.01)

(52) U.S. Cl.
CPC ..... *A63G 31/02* (2013.01); *A63G 31/16* (2013.01)

(58) Field of Classification Search
CPC ..... A63G 31/02; A63G 31/16; A63J 25/00; G03B 21/062
USPC ..... 472/59, 60, 134; 434/29, 55
See application file for complete search history.

(56) References Cited

U.S. PATENT DOCUMENTS 5,513,990 A 5/1996 Gluck
5,791,903 A * 8/1998 Feuer ..... A63G 31/16 434/30
6,095,926 A * 8/2000 Hettema ..... A63G 31/16 472/43
9,353,903 B2 5/2016 Kang et al.
9,511,299 B1 * 12/2016 Lai ..... A63G 31/02
2015/0030999 A1 1/2015 Lee et al.
2021/0072631 A1 * 3/2021 Kaufmann ..... G03B 21/54

FOREIGN PATENT DOCUMENTS

CN 106898234 A 6/2017
EP 3804826 A 4/2021
JP 2016212236 A 12/2016
KR 20110114199 A 10/2011
(Continued)

OTHER PUBLICATIONS

Office Action in corresponding Korean patent application No. 10-2022-0067916 and English abstract thereof.
(Continued)

*Primary Examiner* — Kien T Nguyen
(74) *Attorney, Agent, or Firm* — NZ CARR LAW OFFICE

(57) ABSTRACT

A motion simulating apparatus includes a support base, a coupling part, an occupant platform adapted to carry one or more occupants, and two linear actuators. The coupling part is pivotally connected to the support base about a first pivot axis. The occupant platform is disposed above the support base and is pivotally connected to the coupling part about a second pivot axis, the first pivot axis being substantially orthogonal to the second pivot axis. The two linear actuators are respectively disposed at two opposite sides of the second pivot axis, wherein the two linear actuators are respectively connected pivotally to the support base and are respectively connected pivotally to the occupant platform at the two opposite sides of the second pivot axis.

22 Claims, 6 Drawing Sheets

(56) References Cited

FOREIGN PATENT DOCUMENTS

| | | | |
|---|---|---|---|
| TW | M515057 | U | 1/2016 |
| WO | 2011064560 | A | 6/2011 |
| WO | 2019031539 | A1 | 2/2019 |
| WO | 2020154758 | A1 | 8/2020 |

OTHER PUBLICATIONS

Office Action and search report issued on May 23, 2022 on Taiwanese counterpart 110123470 along with English translation of search report.
Office Action in corresponding Japanese patent application No. 2022-097681 mailed on May 30, 2023, and an English translation thereof.
EESR in corresponding European patent application No. 22172022.0 dated Oct. 17, 2022.
Office Action in corresponding Philippine patent application No. 1/2022/050201.

* cited by examiner

MOTION SIMULATING APPARATUS

CROSS-REFERENCE TO RELATED APPLICATION(S)

This application claims priority to Taiwan patent application no. 110123470 filed on Jun. 26, 2021.

BACKGROUND

1. Field of the Invention

The present invention relates to motion simulating apparatuses that can carry at least one occupant and create the feeling of being in a real motion environment.

2. Description of the Related Art

Motion simulators may be typically used as amusement or training equipment. Generally, a motion simulator includes a plurality of actuators that are respectively disposed at different locations and along different axes of movements so as to be able to simulate motions along different axes. Unfortunately, the conventional motion simulators are usually complex in construction and have relatively high manufacturing costs.

Therefore, there is a need for a motion simulating apparatus that can address at least the aforementioned issues.

SUMMARY

The present application describes a motion simulating apparatus that can address at least the foregoing issues.

According to one aspect, a motion simulating apparatus described herein includes a support base, a coupling part, an occupant platform adapted to carry one or more occupant, and two linear actuators. The coupling part is pivotally connected to the support base about a first pivot axis. The occupant platform is disposed above the support base and is pivotally connected to the coupling part about a second pivot axis, the first pivot axis being substantially orthogonal to the second pivot axis. The two linear actuators are respectively disposed at two opposite sides of the second pivot axis, wherein the two linear actuators are respectively connected pivotally to the support base and are respectively connected pivotally to the occupant platform at the two opposite sides of the second pivot axis.

According to another aspect, a motion simulating apparatus described herein includes a support base, a coupling part, an occupant platform adapted to carry one or more occupants, and an actuating system. The coupling part is pivotally connected to the support base about a first pivot axis. The occupant platform is disposed above the support base and is pivotally connected to the coupling part about a second pivot axis, the first pivot axis being substantially orthogonal to the second pivot axis. The actuating system is connected with the occupant platform, and is operable to cause the occupant platform to rotate about the first pivot axis and the second pivot axis.

DETAILED DESCRIPTION OF THE EMBODIMENTS

Figure 1:
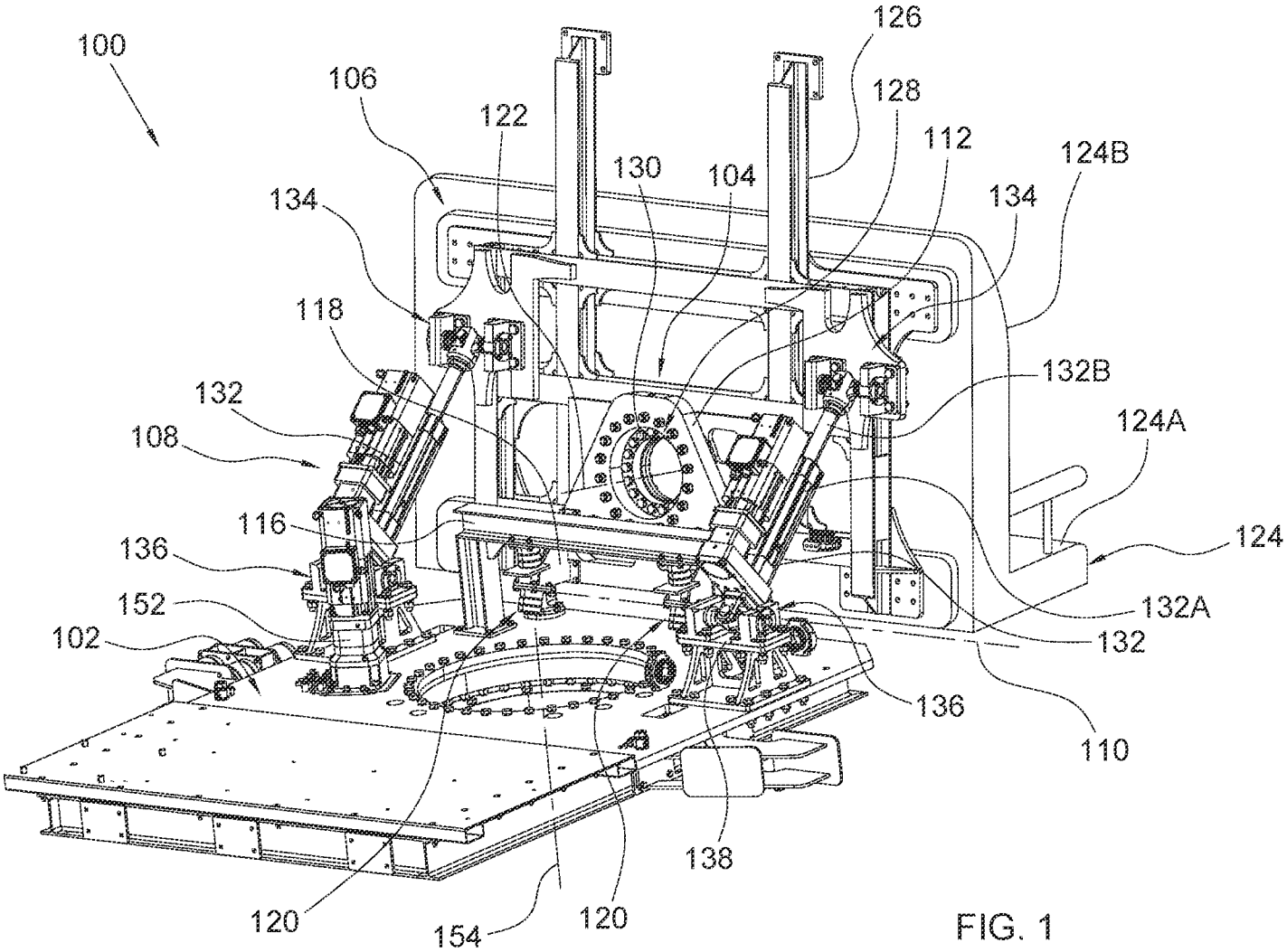
FIG. 1 is a perspective view illustrating an embodiment of a motion simulating apparatus.
Figure 2:
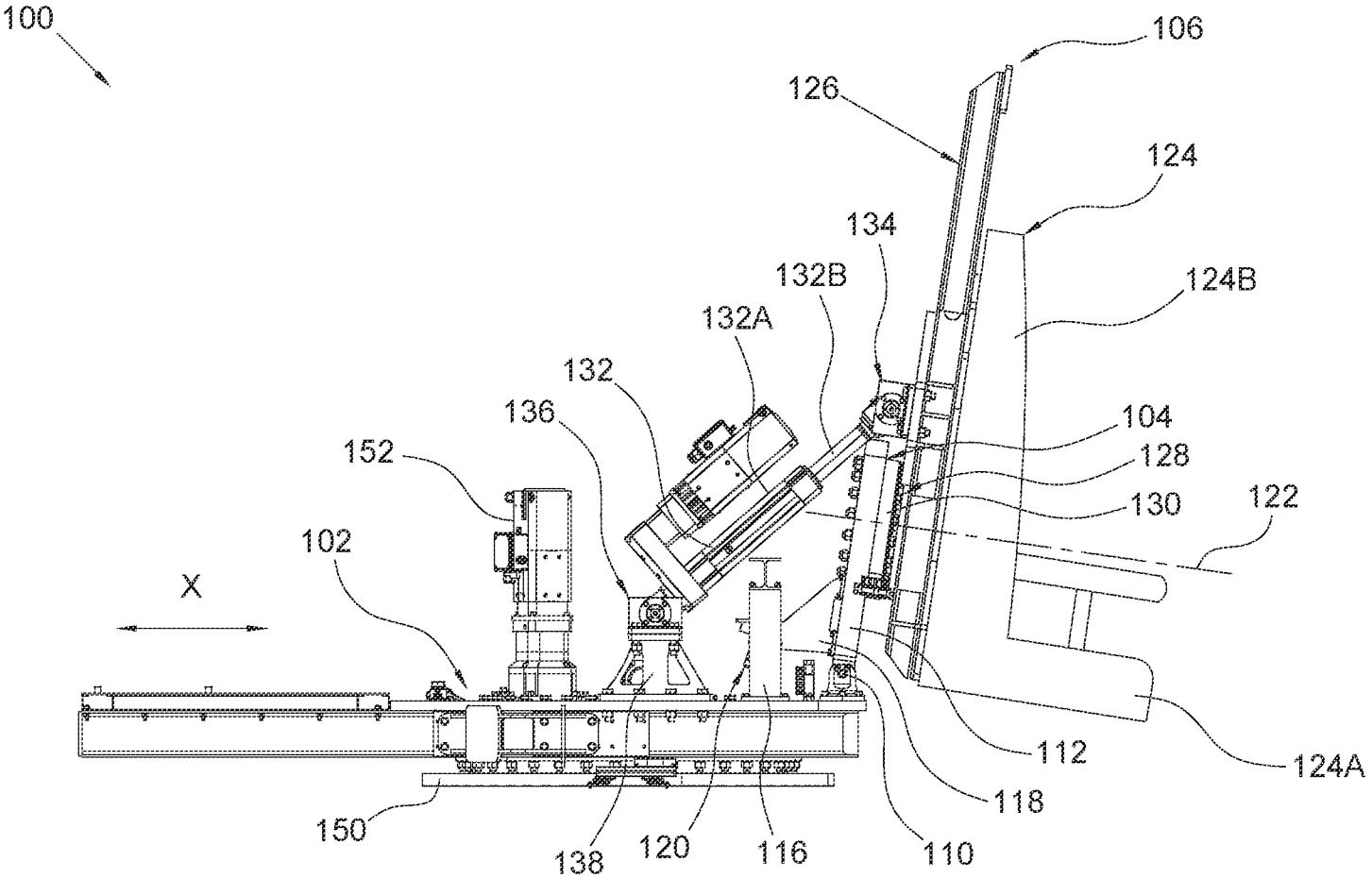
FIG. 2 is a side view illustrating the motion simulating apparatus.
Figure 3:
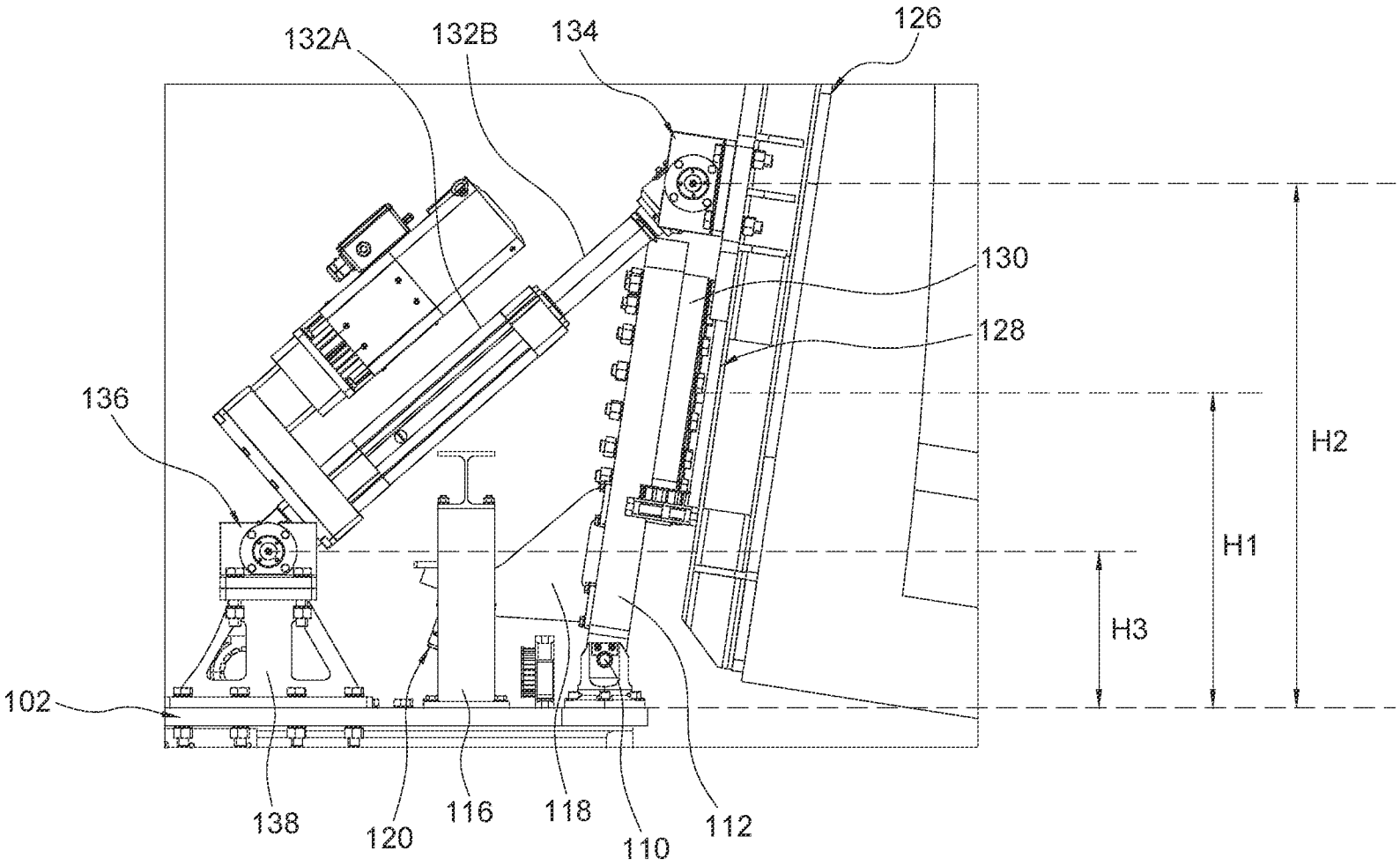
FIG. 3 is an enlarged view illustrating a portion of the motion simulating apparatus shown in FIG. 2.
Figure 4:
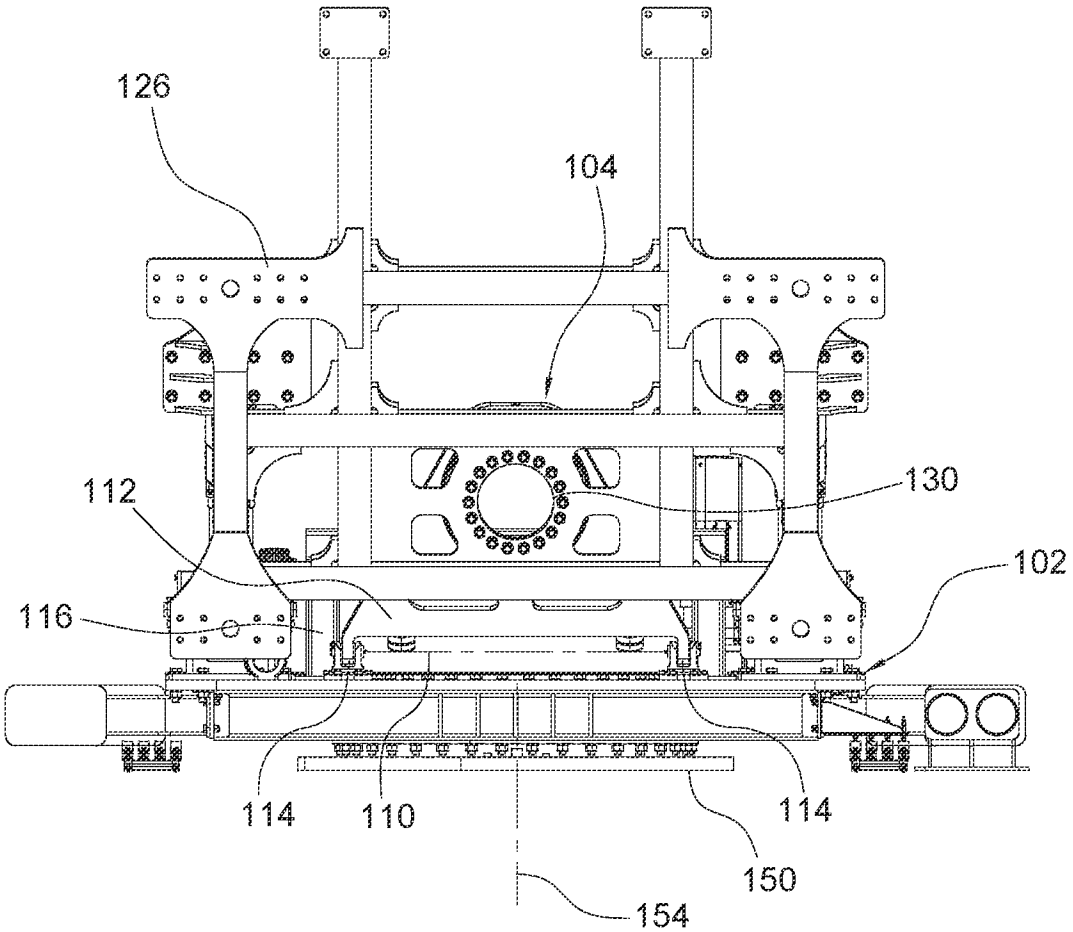
FIG. 4 is a front view illustrating a portion of the motion simulating apparatus.
Figure 5:
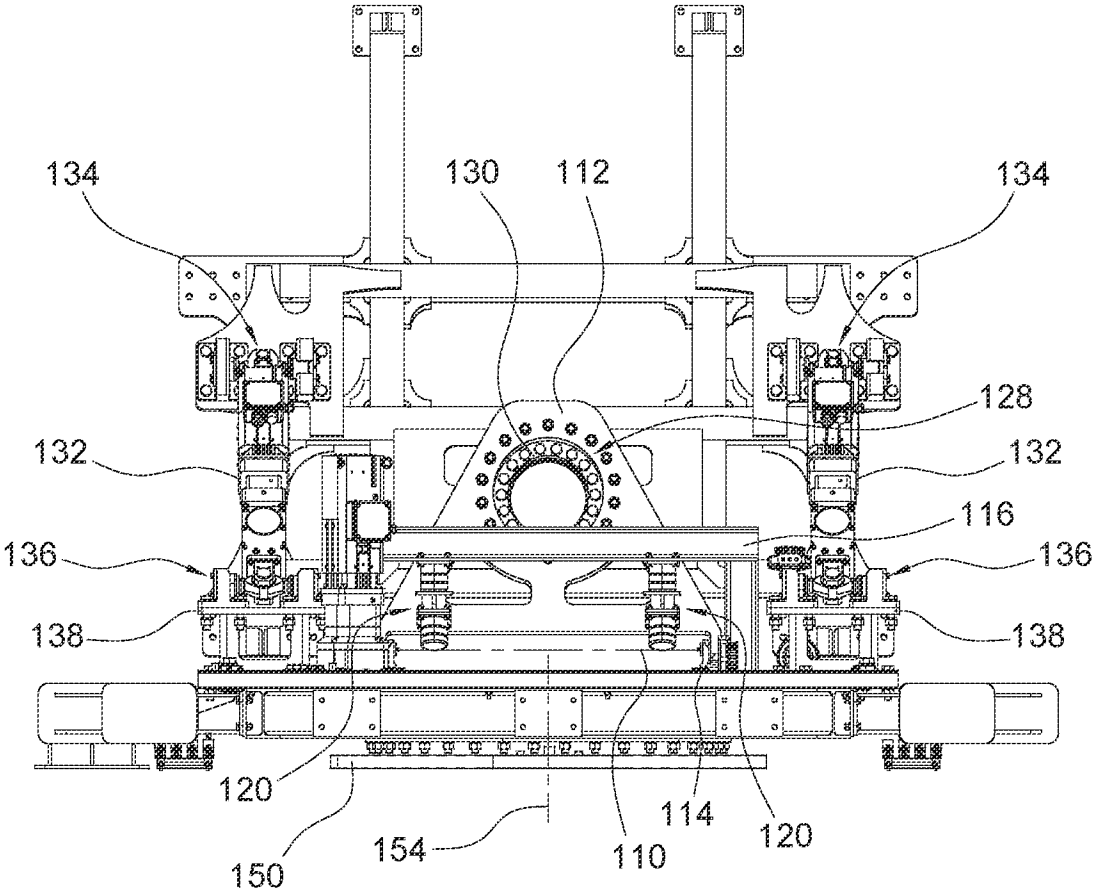
FIG. 5 is a rear view illustrating a portion of the motion simulating apparatus.
Figure 6:
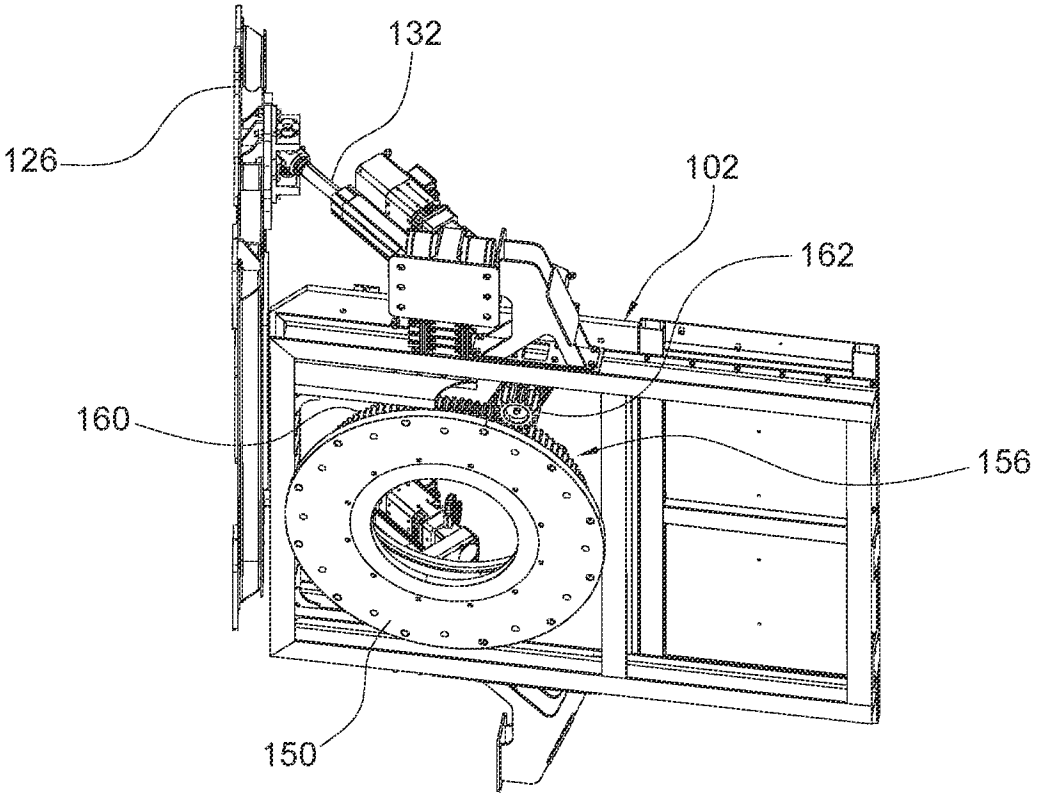
FIG. 6 is a perspective view illustrating a bottom portion of the motion simulating apparatus.

FIG. 1 is a perspective view illustrating an embodiment of a motion simulating apparatus 100. FIG. 2 is a side view illustrating the motion simulating apparatus 100. FIG. 3 is an enlarged view illustrating a portion of the motion simulating apparatus 100 shown in FIG. 2. FIG. 4 is a front view illustrating a portion of the motion simulating apparatus 100. FIG. 5 is a rear view illustrating a portion of the motion simulating apparatus 100. FIG. 6 is a perspective view illustrating a bottom portion of the motion simulating apparatus 100. The motion simulating apparatus 100 can carry occupants or passengers and generate motions in different directions, which is suitable for applications such as simulating platforms or amusement equipment. Referring to FIGS. 1-6, the motion simulating apparatus 100 can include a support base 102, a coupling part 104, an occupant platform 106 and an actuating system 108.

The support base 102 can extend generally horizontally, and can provide support for the coupling part 104, the occupant platform 106 and the actuating system 108. According to an example of construction, the support base 102 can include a plate structure.

The coupling part 104 is pivotally connected to the support base 102 about a pivot axis 110, whereby the coupling part 104 can rotate about the pivot axis 110 relative to the support base 102. The pivot axis 110 can be a substantially horizontal axis. According to an example of construction, the coupling part 104 can include a frame portion 112, and two extensions 114 fixedly connected with the frame portion 112. The coupling part 104 including the frame portion 112 and the two extensions 114 may be integrally formed as a single part, or may be assembled by attaching the two extensions 114 to the frame portion 112 via fasteners. The frame portion 112 is adapted to couple to the occupant platform 106, and the two extensions 114 can protrude at an underside of the frame portion 112 and respectively connect pivotally to the support base 102 about the pivot axis 110. According to an example of construction, the frame portion 112 may be generally shaped as a triangle or an isosceles trapezoid, and the two extensions 114 can respectively protrude from two corners of the frame portion 112 at the underside thereof. The support base 102 may further include a support frame 116, and the coupling part 104 can include two brackets 118 that are respectively connected with the support frame 116 via two cushioning parts 120. The support frame 116 can be exemplarily fixed on the support base 102. Examples of the cushioning parts 120 may include, without limitation, springs, hydraulic cylinders, pneumatic cylinders, and the like. The cushioning parts 120 can provide cushioning support for the coupling part 104.

Referring to FIGS. 1-6, the occupant platform 106 is disposed above the support base 102, and is adapted to carry one or more occupants. The occupant platform 106 can be pivotally connected to the coupling part 104 about a pivot axis 122, whereby the occupant platform 106 can rotate about the pivot axis 122 relative to the coupling part 104 and the support base 102. The pivot axis 110 can be substantially orthogonal to the pivot axis 122, and can be located at an underside of the pivot axis 122. According to an example of construction, the occupant platform 106 can include at least one seat 124 and a seat support frame 126. The seat 124 is schematically shown in FIGS. 1 and 2 only, and is omitted in the other views for better illustration of other construction details. The seat 124 can be fixedly connected with the seat support frame 126, and can include a seat portion 124A and a backrest portion 124B that define at least partially a seating space for an occupant. According to an example of construction, the seat support frame 126 can be fixedly connected with a plurality of seats 124 disposed in a row, and an occupant can sit on any of the seats 124 with the feet hanging above a ground.

According to an example of construction, the seat support frame 126 can include one or more support bars and/or one or more plates assembled together. The seat support frame 126 may be fixedly connected with the backrest portion 124B of each seat 124, and may be pivotally connected to the coupling part 104 about the pivot axis 122 at a rear of the seats 124. For example, the seat support frame 126 can be pivotally connected to the frame portion 112 of the coupling part 104 via a bearing 130 at a pivot connecting location 128, the bearing 130 defining the pivot axis 122. The bearing 130 may include, without limitation, a ball bearing, a cylinder bearing, and the like. According to an example of construction, the bearing 130 can be disposed at a middle location of the seat support frame 126, and most of the bearing 130 can be arranged above the support frame 116 and the cushioning parts 120. As shown in FIGS. 1-5, the coupling part 104 and the seat support frame 126 can extend along substantially parallel planes for a compact assembly.

The actuating system 108 is connected with the occupant platform 106, and is operable to drive the occupant platform 106 to rotate about the pivot axes 110 and 122. More specifically, the actuating system 108 can include at least one linear actuator 132 connected with the occupant platform 106, the linear actuator 132 being operable to drive the occupant platform 106 to rotate relative to the support base 102. The linear actuator 132 may include, e.g., an electric cylinder. However, it will be appreciated that the linear actuator 132 may be of any types, which can include, without limitation, pneumatic cylinders and hydraulic cylinders.

According to an example of construction, the actuating system 108 can include two linear actuators 132 that are respectively connected pivotally to the support base 102 and are respectively connected pivotally to the occupant platform 106 at two opposite sides of the pivot axis 122. One or both of the two linear actuators 132 may apply a force on the occupant platform 106 so as to generate a torque adapted to cause the occupant platform 106 to rotate about the pivot axis 110 and/or the pivot axis 122. More specifically, the force exerted by the two linear actuators 132 on the occupant platform 106 may be able to generate a torque about each of the two pivot axes 110 and 122, and the torque amount may be modified by controlling the course of each of the two linear actuators 132 to cause the occupant platform 106 to rotate about the pivot axis 110 and/or the pivot axis 122.

Referring to FIGS. 1-6, the two linear actuators 132 are respectively connected pivotally to the occupant platform 106 at two pivot connecting locations 134, and are respectively connected pivotally to the support base 102 at two pivot connecting locations 136. The pivot connecting location 128 of the bearing 130 is at a height H1 relative to the support base 102, which can be between a height H2 of the pivot connecting locations 134 relative to the support base 102 and a height H3 of the pivot connecting locations 136 relative to the support base 102. According to an example of construction, the two linear actuators 132 can be symmetrically disposed at two opposite sides of the pivot axis 122 so that the pivot axis 122 is substantially equidistant to the two pivot connecting locations 134 and is also substantially equidistant to the two pivot connecting locations 136. According to an example of construction, each of the two linear actuators 132 can include a barrel 132A and a sliding rod 132B slidably connected with each other, the barrel 132A being pivotally connected to the support base 102 at the pivot connecting location 136, and the sliding rod 132B being pivotally connected to the occupant platform 106 at the pivot connecting location 134. The barrel 132A can be pivotally connected to a pivot mount 138 that is fixedly connected with the support base 102, wherein the pivot mount 138 is disposed at a rear of the support frame 116 so that the support frame 116 is located between the coupling part 104 and the pivot mount 138 along a front-to-rear axis X of the support base 102. Accordingly, the two linear actuators 132 can be tilted an angle relative to the pivot axis 122. According to a symmetrical arrangement, the two linear actuators 132 can extend substantially parallel to each other between the pivot connecting locations 134 and the pivot connecting locations 136, and can respectively move along two parallel vertical planes.

It is worth noting that the two linear actuators 132 are not limited to the aforementioned arrangement. According to another example of construction, the two linear actuators 132 may be symmetrically disposed at two opposite sides of the pivot axis 122 but may not extend parallel to each other between the pivot connecting locations 134 and the pivot connecting locations 136. More specifically, the two linear actuators 132 may be disposed so that the pivot axis 122 is substantially equidistant to the two pivot connecting locations 134 by a first distance, and substantially equidistant to the two pivot connecting locations 136 by a second distance that differs from the first distance.

According to another example of construction, the two linear actuators 132 may be disposed equally distant at two opposite sides of the pivot axis 122 but not according to a symmetric arrangement, and the occupant platform 106 can be driven to rotate about the pivot axis 110 and/or the pivot axis 122 by controllably imparting a differential course between the two linear actuators 132.

In the actuating system 108, the two linear actuators 132 thus may be disposed at two opposite sides of the pivot axis 122 according to any suitable symmetric or asymmetric arrangements for driving the occupant platform 106 to rotate about the pivot axis 110 and/or the pivot axis 122.

According to an embodiment, the pivot axis 110 can be a pitch axis, the pivot axis 122 can be a roll axis, and the two linear actuators 132 are operable to cause the occupant platform 106 to rotate about the pivot axis 110 and/or to rotate about the pivot axis 122 for simulating pitch and/or roll motions. For example, the two linear actuators 132 can be operated to generate synchronous and identical courses to cause the occupant platform 106 and the coupling part 104 to pitch up and down about the pivot axis 110 relative to the support base 102, and the two linear actuators 132 can be operated to generate different courses to cause the occupant platform 106 to rotate about the pivot axis 122 to the left and right side relative to the support base 102 and the coupling part 104. With the arrangement of the support base 102, the coupling part 104 and the occupant platform 106 as described herein, the actuating system 108 can have a simple construction capable of simulating pitch and roll motions with two linear actuators 132. Examples of applications for the motion simulating apparatus 100 described herein may include, without limitation, flight simulators.

It will be appreciated that the actuating system 108 is not limited to the aforementioned configuration. For example, a variant construction of the actuating system 108 can include an electric motor, which may be additionally provided in the actuating system 108 or substitute for one of the two linear actuators 132, wherein the electric motor is connected with the occupant platform 106 and is operable to drive the occupant platform 106 to rotate about the pivot axis 122.

Referring to FIGS. 1-6, the motion simulating apparatus 100 can further include a bottom part 150 and a motor 152. The bottom part 150 can be disposed below the support base 102, which can be pivotally connected to the bottom part 150 about a pivot axis 154. The pivot axis 154 may extend substantially vertically. The motor 152 can be an electric motor, and is operable to drive the support base 102 to rotate about the pivot axis 154 relative to the bottom part 150. According to an example of construction, the motor 152 can be mounted on the support base 102, and can drive the support base 102 in rotation via a gear train 156. For example, the gear train 156 can include multiple gears 160 and 162, the gear 160 being fixedly connected with the bottom part 150, and the gear 162 being connected with an output axle of the motor 152 and meshed with the gear 160. The motor 152 is operable to cause the occupant platform 106 to rotate about the pivot axis 154. The ability to rotate the occupant platform 106 about the pivot axis 154 may save space for switching between a loading position and a watching position. For example, the occupant platform 106 can be rotated to face one side (loading position) so that occupants can get on and get off the occupant platform 106, and may be rotated 180 degrees to face another side facing a screen (watching position) for performing motion simulation after the occupants are seated on the occupant platform 106. Of course, the occupant platform 106 may also be driven to rotate about the pivot axis 154 to simulate a yaw motion during operation.

Advantages of the structures described herein include the ability to provide a motion simulating apparatus that is relatively simple in construction, and can be manufactured with reduced cost. Moreover, the motion simulating apparatus described has a reduced size, which may be particularly suitable for use in environments of limited space.

Realizations of the structures have been described only in the context of particular embodiments. These embodiments are meant to be illustrative and not limiting. Many variations, modifications, additions, and improvements are possible. Accordingly, plural instances may be provided for components described herein as a single instance. Structures and functionality presented as discrete components in the exemplary configurations may be implemented as a combined structure or component. These and other variations, modifications, additions, and improvements may fall within the scope of the claims that follow.

What is claimed is:

1. A motion simulating apparatus comprising:

a support base;

a coupling part, pivotally connected to the support base about a first pivot axis;

an occupant platform adapted to carry one or more occupants, the occupant platform being disposed above the support base and pivotally connected to the coupling part about a second pivot axis, the first pivot axis being substantially orthogonal to the second pivot axis; and two linear actuators respectively disposed at two opposite sides of the second pivot axis, wherein the two linear actuators are respectively connected pivotally to the support base and are respectively connected pivotally to the occupant platform at the two opposite sides of the second pivot axis;

wherein the occupant platform includes at least one seat, and a seat support frame fixedly connected with a backrest portion of the at least one seat, the seat support frame being pivotally connected to the coupling part about the second pivot axis at a rear of the at least one seat.

2. The motion simulating apparatus according to claim 1, wherein the first pivot axis is located at an underside of the second pivot axis.

3. The motion simulating apparatus according to claim 1, wherein the two linear actuators are symmetrically disposed at the two opposite sides of the second pivot axis.

4. The motion simulating apparatus according to claim 1, wherein the two linear actuators are parallel to each other and are respectively connected pivotally to the occupant platform at two pivot connecting locations, the second pivot axis being substantially equidistant to the two pivot connecting locations.

5. The motion simulating apparatus according to claim 1, wherein the two linear actuators are tilted an angle relative to the second pivot axis.

6. The motion simulating apparatus according to claim 1, wherein the two linear actuators are operable to cause the occupant platform to rotate about the first pivot axis.

7. The motion simulating apparatus according to claim 1, wherein the two linear actuators are operable to cause the occupant platform to rotate about the second pivot axis.

8. The motion simulating apparatus according to claim 1, wherein the two linear actuators are respectively connected pivotally to the occupant platform at two first pivot connecting locations and are respectively connected pivotally to the support base at two second pivot connecting locations, and the occupant platform is pivotally connected to the coupling part at a third pivot connecting location, the third pivot connecting location being at a height relative to the support base that is between a height of the two first pivot connecting locations relative to the support base and a height of the two second pivot connecting locations relative to the support base.

9. The motion simulating apparatus according to claim 1, wherein the coupling part includes a frame portion and two extensions, the frame portion being adapted to couple to the occupant platform, the two extensions protruding at an underside of the frame portion and being respectively connected pivotally to the support base about the first pivot axis.

10. The motion simulating apparatus according to claim 1, further comprising a bottom part and a motor, the support base being pivotally connected to the bottom part about a third pivot axis that extends substantially vertically, the motor being operable to drive the support base to rotate about the third pivot axis relative to the bottom part.

11. The motion simulating apparatus according to claim 1, wherein the support base includes a support frame, and the coupling part includes two brackets that are respectively connected with the support frame via two cushioning parts.

12. The motion simulating apparatus according to claim 1, wherein the first pivot axis is a pitch axis, and the second pivot axis is a roll axis.

13. A motion simulating apparatus comprising:

a support base;

a coupling part, pivotally connected to the support base about a first pivot axis;

an occupant platform adapted to carry one or more occupants, the occupant platform being disposed above the support base and pivotally connected to the coupling part about a second pivot axis, the first pivot axis being substantially orthogonal to the second pivot axis;

an actuating system connected with the occupant platform, the actuating system being operable to cause the occupant platform to rotate about the first pivot axis and the second pivot axis; and a bottom part and a motor, the support base being pivotally connected to the bottom part about a third pivot axis that extends substantially vertically, the motor being operable to drive the support base to rotate about the third pivot axis relative to the bottom part.

14. The motion simulating apparatus according to claim 13, wherein the first pivot axis is located at an underside of the second pivot axis.

15. The motion simulating apparatus according to claim 13, wherein the actuating system includes at least one linear actuator that is pivotally connected to the occupant platform at a first pivot connecting location and is pivotally connected to the support base at a second pivot connecting location.

16. The motion simulating apparatus according to claim 15, wherein the occupant platform is pivotally connected to the coupling part at a third pivot connecting location, the third pivot connecting location being at a height relative to the support base that is between a height of the first pivot connecting location relative to the support base and a height of the second pivot connecting location relative to the support base.

17. The motion simulating apparatus according to claim 15, wherein the linear actuator is tilted an angle relative to the second pivot axis.

18. The motion simulating apparatus according to claim 13, wherein the coupling part includes a frame portion and two extensions, the frame portion being adapted to couple to the occupant platform, the two extensions protruding at an underside of the frame portion and being respectively connected pivotally to the support base about the first pivot axis.

19. The motion simulating apparatus according to claim 13, wherein the support base includes a support frame, and the coupling part includes two brackets that are respectively connected with the support frame via two cushioning parts.

20. The motion simulating apparatus according to claim 13, wherein the first pivot axis is a pitch axis, and the second pivot axis is a roll axis.

21. A motion simulating apparatus comprising:

a support base;

a coupling part, pivotally connected to the support base about a first pivot axis;

an occupant platform adapted to carry one or more occupants, the occupant platform being disposed above the support base and pivotally connected to the coupling part about a second pivot axis, the first pivot axis being substantially orthogonal to the second pivot axis; and an actuating system connected with the occupant platform, the actuating system being operable to cause the occupant platform to rotate about the first pivot axis and the second pivot axis;

wherein the support base includes a support frame, and the coupling part includes two brackets that are respectively connected with the support frame via two cushioning parts.

22. The motion simulating apparatus according to claim 21, wherein the coupling part further includes a frame portion and two extensions, the frame portion being adapted to couple to the occupant platform, the two extensions protruding at an underside of the frame portion and being respectively connected pivotally to the support base about the first pivot axis.

* * * * *